US008998372B2

(12) United States Patent
Yoshida

(10) Patent No.: US 8,998,372 B2
(45) Date of Patent: Apr. 7, 2015

(54) SCANNING OPTICAL APPARATUS AND IMAGE FORMING APPARATUS

(71) Applicant: KYOCERA Document Solutions Inc., Osaka (JP)

(72) Inventor: Shingo Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/242,604

(22) Filed: Apr. 1, 2014

(65) Prior Publication Data

US 2014/0300677 A1 Oct. 9, 2014

(30) Foreign Application Priority Data

Apr. 5, 2013 (JP) ..... 2013-079533

(51) Int. Cl.
*B41J 29/393* (2006.01)
*G03G 15/043* (2006.01)

(52) U.S. Cl.
CPC ..... *G03G 15/0435* (2013.01)

(58) Field of Classification Search
None
See application file for complete search history.

(56) References Cited

U.S. PATENT DOCUMENTS

| | | | | |
|---|---|---|---|---|
| 7,446,793 | B2 * | 11/2008 | Inagawa et al. | 347/236 |
| 8,120,633 | B2 * | 2/2012 | Koga | 347/236 |
| 8,451,306 | B2 * | 5/2013 | Nagumo | 347/237 |
| 8,537,190 | B2 * | 9/2013 | Sakita | 347/236 |

FOREIGN PATENT DOCUMENTS

| | | |
|---|---|---|
| JP | H05-181076 | 7/1993 |
| JP | H07-199106 | 8/1995 |

* cited by examiner

*Primary Examiner* — Lamson Nguyen
(74) *Attorney, Agent, or Firm* — Knobbe, Martens, Olson & Bear LLP

(57) ABSTRACT

A scanning optical apparatus includes a light beam detection unit, a reference signal generation unit, and a returned light detection unit. The light beam detection unit decides whether the light beam reflected by the reflecting surface of a polygon mirror has entered the BD sensor, through comparison between an output value of the BD sensor and a predetermined first threshold. The reference signal generation unit generates a scan start reference signal in response to the decision that the light beam has entered the BD sensor. The returned light detection unit decides whether the light beam reflected by the reflecting surface has entered the internal light sensor, through comparison between an output value of the internal light sensor and a second threshold corresponding to light beam intensity higher than the intensity of the light beam reflected by the reflecting surface and corresponding to the first threshold.

6 Claims, 14 Drawing Sheets

SCANNING OPTICAL APPARATUS AND IMAGE FORMING APPARATUS

INCORPORATION BY REFERENCE

This application claims priority to Japanese Patent Application No. 2013-079533 filed on Apr. 5, 2013, the entire contents of which are incorporated by reference herein.

BACKGROUND

The present disclosure relates to a scanning optical apparatus and an image forming apparatus incorporated with the scanning optical apparatus.

Image forming apparatuses that employ electrophotography such as printers and copiers are configured to perform scanning with a light beam to thereby form a latent image on a photoconductor drum. The scanning with the light beam is realized by a scanning optical apparatus. The scanning optical apparatus includes a laser diode (LD) serving as the light source, a collimator lens, a cylinder lens, a polygon mirror, and an fθ lens, and deflects with the polygon mirror the light beam from the light source modulated according to the image to be formed, so that the photoconductor drum is scanned with the deflected light beam in a main scanning direction. The polygon mirror includes a plurality of reflecting surfaces that reflect the light beam, for example five surfaces when the polygon mirror has a pentagonal column shape, and a rotary shaft driven to rotate by a driving motor in one direction.

In the scanning optical apparatus thus configured, the respective end portions of the reflecting surfaces adjacent to each other define a predetermined angle according to the number of reflecting surface (108 degrees in the case of pentagonal column shape). When the polygon mirror is made to rotate at a high speed a turbulent flow of air is generated at the corners between the reflecting surfaces, and therefore dust sticks to the leading end portions of the respective reflecting surfaces in the rotating direction owing to the turbulent flow, thus forming fog on the reflecting surfaces. The fog reduces the reflectance of the light beam, thereby degrading the quality of the corresponding portion (marginal portion) of the image to be formed. Here, the light beam reflected at the position where the fog is formed is not only led to the surface to be scanned but also introduced in a beam detect (hereinafter, BD) sensor, and utilized to generate a reference signal that serves as a reference for starting the scanning of the surface to be scanned. Accordingly, the decline in reflectance of the light beam due to the fog disables the generation of the scan start signal, which may lead to malfunction of the apparatus.

As a remedy for the mentioned drawback, a technique of utilizing only a portion of the reflecting surface of the polygon mirror where fog is not assumed to be formed, thereby preventing degradation in image quality, has been developed.

In addition, a scanning optical apparatus without the reflecting mirror and the photodiode (BD sensor) for generating the scan start signal has been developed, for the purpose of reducing the number of parts and simplifying the assembly and adjusting works. This scanning optical apparatus is configured to detect laser beam emitted from a laser oscillation element serving as the light source and reflected by a scanning mirror so as to return to the laser oscillation element, and utilize the detected light to generate the scan start signal. The returned light is detected using random signals generated in the driving current of the laser oscillation element upon receipt of the light.

SUMMARY

In an aspect, the disclosure proposes further improvement of the foregoing technique.

The disclosure provides a scanning optical apparatus including a light source, a polygon mirror, a first sensor, a second sensor, a light beam detection unit, a reference signal generation unit, and a returned light detection unit. The polygon mirror includes a plurality of reflecting surfaces that each reflects a light beam emitted from the light source, and moves the reflecting surfaces to deflect the light beam emitted from the light source, so as to scan a surface to be scanned in a main scanning direction. The first sensor receives the light beam reflected by the reflecting surfaces of the polygon mirror. The second sensor receives the light beam reflected by the reflecting surface and detects intensity of the light beam received, the second sensor being located inside the light source so as to intersect the optical axis of the light beam at a position opposite to an emission outlet of the light beam. The light beam detection unit compares between an output value of the first sensor and a predetermined first threshold, to thereby decide that the light beam reflected by the reflecting surface has entered the first sensor when the output value of the first sensor is equal to or higher than the first threshold, and that the light beam reflected by the reflecting surface has not entered the first sensor when the output value of the first sensor is lower than the first threshold. The reference signal generation unit generates a scan start reference signal for starting scanning of the surface to be scanned with the light beam deflected by the reflecting surface, when the light beam detection unit detects that the light beam has entered the first sensor. The returned light detection unit compares between an output value of the second sensor and a second threshold corresponding to light beam intensity higher than the intensity of the light beam reflected by the reflecting surface and corresponding to the first threshold, to thereby decide that the light beam reflected by the reflecting surface has entered the second sensor when the output value of the second sensor is equal to or higher than the second threshold, and that the light beam reflected by the reflecting surface has not entered the second sensor when the output value of the second sensor is lower than the second threshold.

In another aspect, the disclosure provides an image forming apparatus including the foregoing scanning optical apparatus, an image carrier that carries a toner image to be transferred to a medium, a charger that electrically charges an image carrying surface of the image carrier, and a developing unit that applies a toner to a static latent image formed by exposure of the image carrying surface performed by the scanning optical apparatus, thereby forming a toner image based on the latent image on the image carrying surface.

DETAILED DESCRIPTION

Hereafter, an embodiment of the disclosure will be described in details, with reference to the drawings. The following embodiment represents a digital multifunctional peripheral that includes an exposure unit, corresponding to the scanning optical apparatus in the disclosure.

Figure 1:
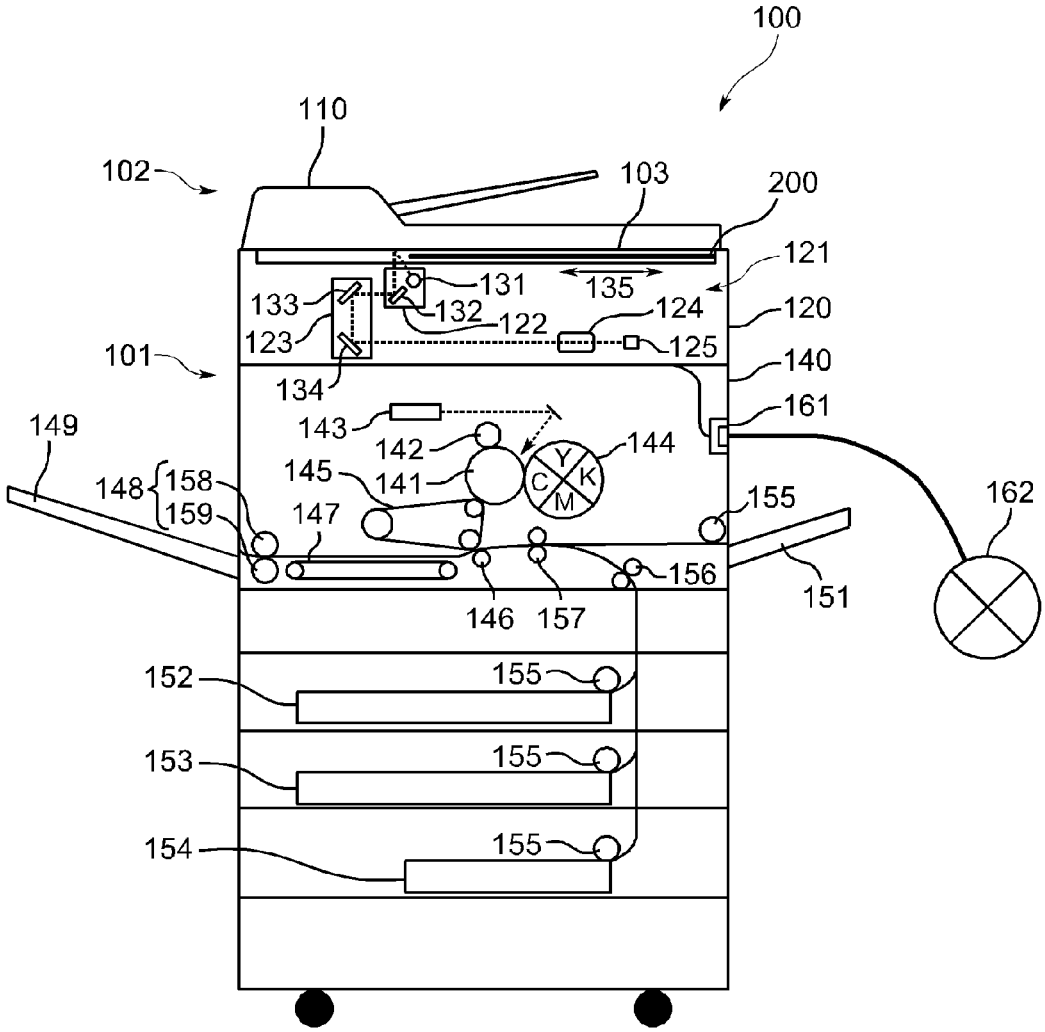
FIG. 1 is a schematic drawing showing a general configuration of a multifunctional peripheral according to an embodiment of the disclosure.

FIG. 1 is a schematic drawing showing a general configuration of the multifunctional peripheral according to this embodiment. As shown in FIG. 1, the multifunctional peripheral 100 comprises a main body 101 including an image reading unit 120 and an image forming unit 140, and a platen cover 102 mounted on top of the main body 101 so as to be opened and closed. A document table 103 is provided on the upper face of the main body 101. The platen cover 102 includes a document feeder 110.

The image reading unit 120 is located under the document table 103. The image reading unit 120 reads the image on a source document with a scanning optical system 121 and generates digital data (image data) of the image. The source document can be placed either on the document table 103 or on the document feeder 110. The scanning optical system 121 includes a first carriage 122, a second carriage 123, and a condenser lens 124. The first carriage 122 includes a light source 131 of a linear shape and a mirror 132, and the second carriage 123 includes mirrors 133 and 134. The light source 131 illuminates the source document. The mirrors 132, 133, 134 lead light reflected by the source document to the condenser lens 124, and the condenser lens 124 focuses the image based on the light on the light receiving surface of a line image sensor 125.

In the scanning optical system 121, the first carriage 122 and the second carriage 123 are set to reciprocate in a sub scanning direction 135. The image on the source document placed on the document table 103 can be read by the image sensor 125 upon moving the first carriage 122 and the second carriage 123 in the sub scanning direction 135. To read the image on the source document set on the document feeder 110, the image reading unit 120 temporarily stops the first carriage 122 and the second carriage 123 at a position corresponding to an image reading position, and reads the image on the source document passing the image reading position with the image sensor 125. The image sensor 125 generates the image data of the source document, for example corresponding to red (R), green (G), and blue (B) colors, on the basis of the image incident on the light receiving surface. The generated image data can be printed on a sheet, corresponding to the medium, in the image forming unit 140. The image data can also be transmitted to a non-illustrated external apparatus from a network interface 161 through a network 162.

The image forming unit 140 serves to print the image data obtained from the image reading unit 120 or received from a non-illustrated external apparatus connected to the network 162, on the sheet. The image forming unit 140 includes a photoconductor drum 141 corresponding to the image carrier. The photoconductor drum 141 rotates at a constant speed in one direction. Around the photoconductor drum 141, a charger 142, an exposure unit (scanning optical apparatus) 143, a developing unit 144, and an intermediate transfer belt 145 are disposed in this order from an upstream side in the rotating direction. The charger 142 uniformly charges the surface of the photoconductor drum 141. The exposure unit 143 emits the light based on the image data onto the uniformly charged surface of the photoconductor drum 141, thereby forming a static latent image on the photoconductor drum 141. The developing unit 144 applies a toner on the static latent image thus forming a toner image on the photoconductor drum 141. The intermediate transfer belt 145 transfers the toner image on the photoconductor drum 141 onto the sheet. When the image data represents a color image, the intermediate transfer belt 145 transfers the toner image of each color on the same sheet. Here, the color image based on RGB colors is converted into image data based on cyan (C), magenta (M), yellow (Y), and black (K), and the image data of the respective colors is inputted to the exposure unit 143.

The image forming unit 140 delivers the sheet from a manual feed tray 151 or a paper feed cassette 152, 153, or 154 to the transfer nip between the intermediate transfer belt 145 and a transfer roller 146. Sheets of various sizes can be loaded in the manual feed tray 151 and the paper feed cassettes 152, 153, 154. The image forming unit 140 selects a sheet designated by the user or a sheet of a size corresponding to the size of the source document automatically detected, and delivers the selected sheet from the manual feed tray 151 or cassette 152, 153, 154, with a feed roller 155. The delivered sheet is transported to the transfer nip by a transport roller 156 and a resist roller 157. The sheet having the toner image transferred thereon is transported to a fixing unit 148 by a transport belt 147. The fixing unit 148 includes a fixing roller 158 with a built-in heater and a pressure roller 159, and fixes the toner image on the sheet with heat and pressure. The image forming unit 140 then discharges the sheet that has passed the fixing unit 148 to an output tray 149.

Figure 2:
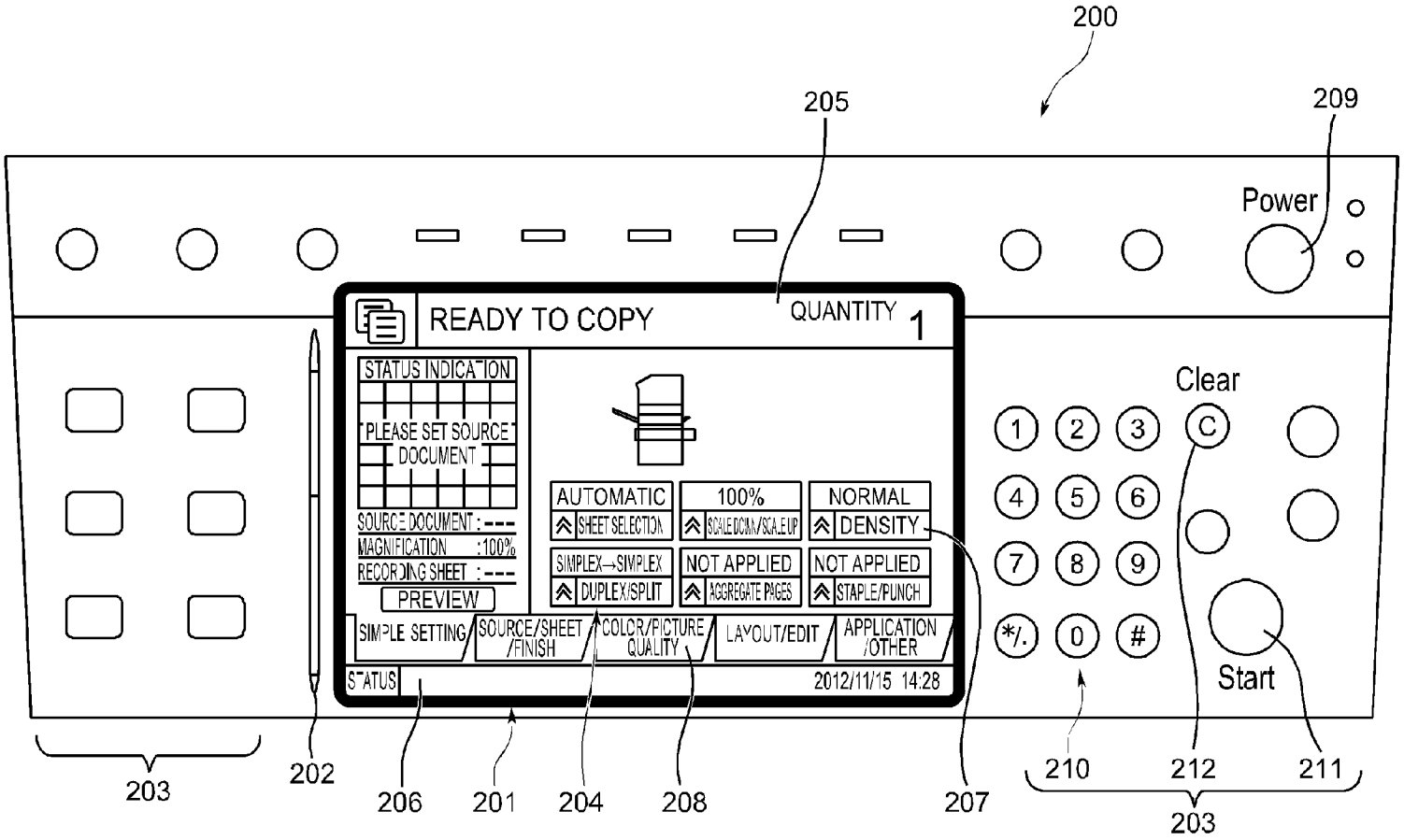
FIG. 2 is a schematic drawing showing an operation panel of the multifunctional peripheral according to the embodiment.

FIG. 2 is a schematic drawing showing an appearance of an operation panel of the multifunctional peripheral 100. The user can input instructions such as start of copying to the multifunctional peripheral 100, and confirm the status or setting of the multifunctional peripheral 100, through the operation panel 200. The operation panel 200 includes a display window 201 with touch panel and operation keys 203. The user can use his/her fingers or a touch pen 202, to make inputs through the display window 201.

The display window 201 displays an operation screen including a button display area 204, a message display area 205 and a status display area 206. The button display area 204 is provided with a plurality of tabs 208, in each of which operation buttons related to the category of the tab are arranged. In the example shown in FIG. 2, the tab displayed includes the buttons for setting a sheet size, copy magnification, printing density, simplex or duplex printing, aggregate printing, and post processing. The user can access the mentioned setting screen by selecting the corresponding tab 208. While the selected tab is displayed, items corresponding to the remaining tabs are hidden in the operation screen.

In the message display area 205, messages indicating whether copying is possible, the number of copies, and so forth are displayed for the user. In the status display area 206, apparatus status information is displayed if need be. The display in this area reflects detection results obtained by the sensors provided in the multifunctional peripheral 100. The apparatus status information refers to messages notifying the user that some kind of action has to be taken, though the apparatus is normally operating for the moment. Examples of such information include messages notifying that the sheets are about to run out, that the document table 103 is stained, and that a facsimile message has been stored in the memory (in the case where the memory reception mode is active). In addition, the apparatus status information may include messages notifying that the sheet has run out, and that the sheet is jammed in the transport route.

The operation keys 203 include a main power key 209, a ten-key 210, a start key 211, and a clear key 212. For example, the main power key 209 is used for turning on and off the multifunctional peripheral 100. The ten-key 210 can be used for inputting the number of copies and copy magnification. When the user inputs such settings, the multifunctional peripheral 100 displays, for example, such a message as "Ready to copy (settings made)" in the message display area 205, to notify the user that the settings have been inputted by the user. The start key 211 is used for starting the copying or printing operation. The clear key 212 is used for cancelling the settings that the user has made. Since the user can recognize whether the settings of the user have been accepted by the apparatus in view of the mentioned message, the user can press the clear key 212 when those settings become unnecessary.

Figure 3:
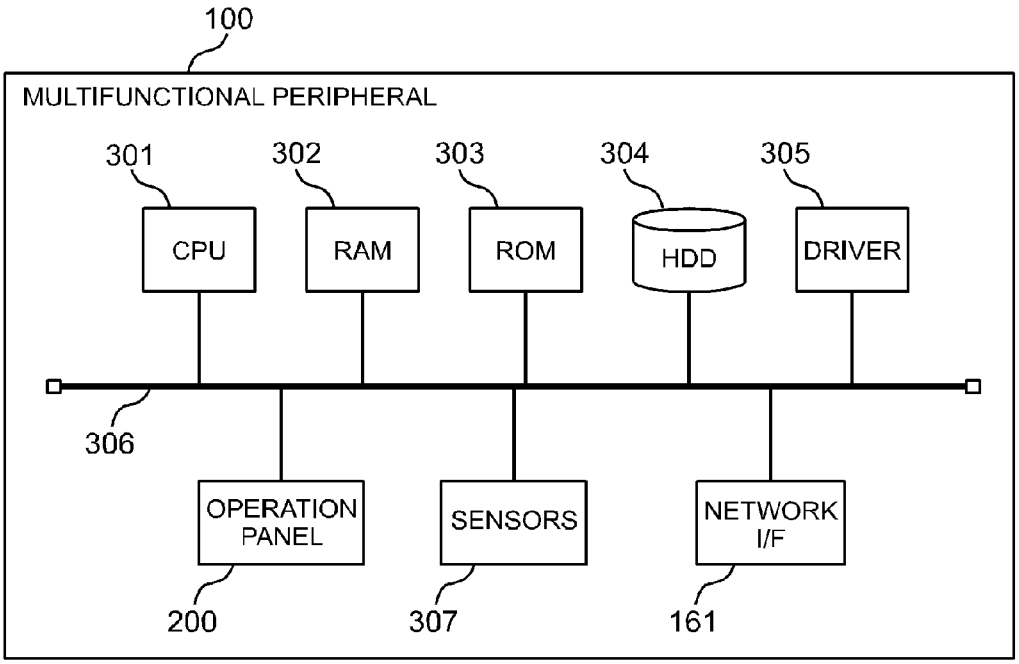
FIG. 3 is a block diagram showing a hardware configuration of the multifunctional peripheral according to the embodiment.

FIG. 3 is a block diagram showing a hardware configuration of the control system of the multifunctional peripheral 100. The multifunctional peripheral 100 according to this embodiment includes a central processing unit (CPU) 301, a random access memory (RAM) 302, a read only memory (ROM) 303, a hard disk drive (HDD) 304, and a driver 305, connected to each other via an internal bus 306. The driver 305 corresponds to the respective driving units of the document feeder 110, the image reading unit 120, and the image forming unit 140. The ROM 303 and the HDD 304 contains programs, and the CPU 301 controls the multifunctional peripheral 100 according to the commands of the control program. For example, the CPU 301 utilizes the RAM 302 as an operation region, to transmit and receive data and commands to and from the driver 305 thereby controlling the operation of the mentioned driving units. The HDD 304 is also used for accumulating the image data acquired by the image reading unit 120 and the image data received from external apparatuses through the network interface 161.

The operation panel 200 and sensors 307 are also connected to the internal bus 306. The operation panel 200 accepts operations of the user and provides signals based on the user's operations to the CPU 301. The display window 201 displays the aforementioned operation screen according to the control signal from the CPU 301. The sensors 307 include a position sensor for the platen cover 102, a sensor for detecting the source document on the document table 103, a temperature sensor in the fixing unit 148, and a sensor for detecting the source document or the sheet being transported.

The CPU 301 activates the functional blocks described below, for example by executing the program stored in the ROM 303, and controls the functional blocks according to the signal from the sensors cited above.

Figure 4:
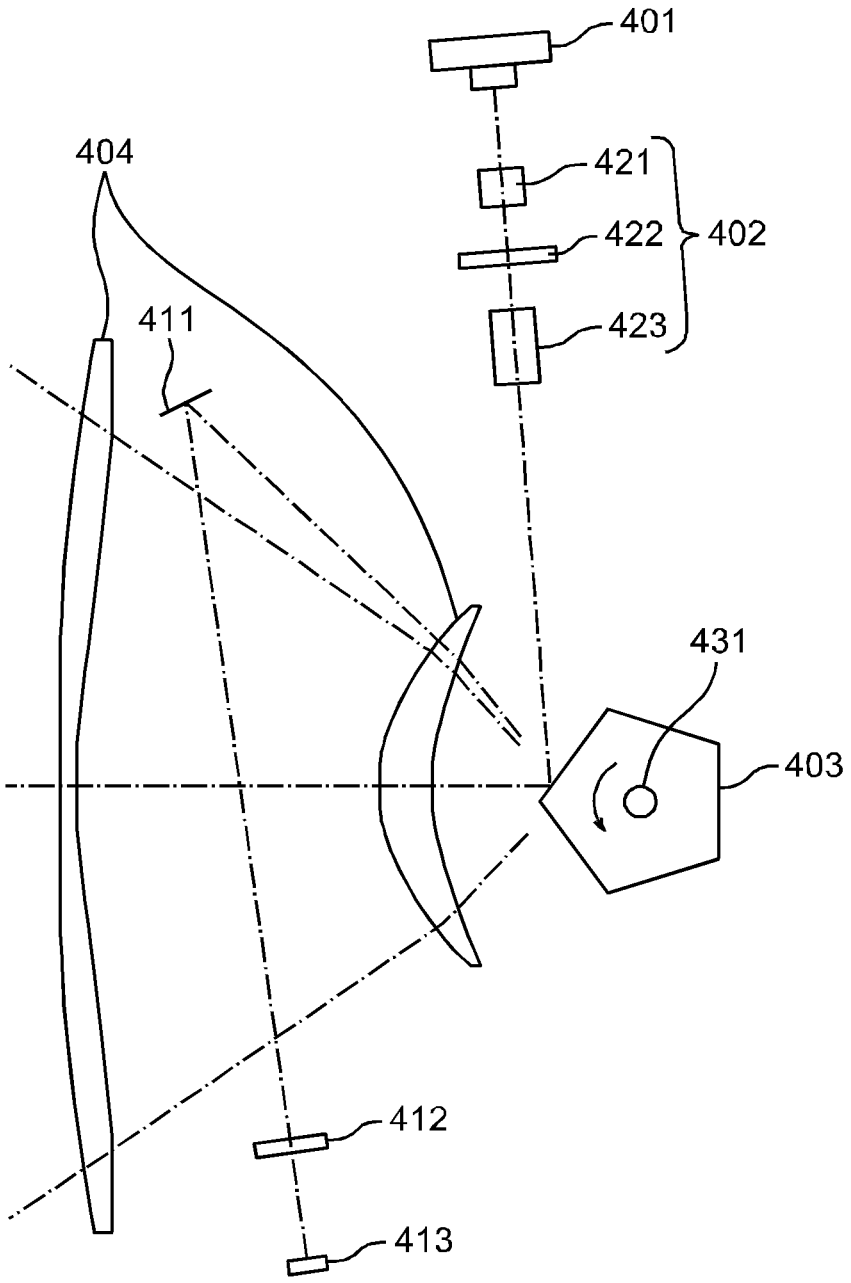
FIG. 4 is a schematic diagram showing a configuration of an exposure unit according to the embodiment.

FIG. 4 is a schematic diagram showing a configuration of the exposure unit 143 in the multifunctional peripheral 100. The exposure unit 143 includes a light source 401, an input optical system 402, a polygon mirror 403, and a scanning optical system 404, enclosed in a non-illustrated housing. Although the optical path of the light beam shown in FIG. 4 does not include a return path, a return mirror may be employed to form the return path of the light beam.

The light source 401 is constituted of a laser diode (laser oscillator) implemented on a circuit board. The circuit board modulates the intensity of the light beam (laser beam) emitted by the laser diode according to the image signal inputted from outside.

The input optical system 402 includes a collimator lens 421, an aperture 422, and a cylinder lens 423. The light beam emitted from the light source 401 enters the collimator lens 421. The collimator lens 421 is a cylindrical glass lens, and converts the light beam emitted from the laser diode into parallel light coinciding with the optical axis of the collimator lens 421 and outputs such parallel light. The light beam that has passed the collimator lens 421 proceeds to the reflecting surface of the polygon mirror 403 through the aperture 422 and the cylinder lens 423. Here, the emission point of the laser diode is located at the focal point of the collimator lens 421.

The polygon mirror 403 includes a plurality of reflecting surfaces that reflect the light beam emitted from the light source 401, and serves as a deflector that causes, by moving the reflecting surfaces, the light beam emitted from the light source 401 to scan the surface of the photoconductor drum 141, corresponding to the surface to be scanned, in the main scanning direction. The polygon mirror 403 includes a rotary shaft 431 oriented perpendicular to the scanning direction of the light beam on the surface of the photoconductor drum 141, and the rotary shaft 431 is driven to rotate in one direction indicated by an arrow in FIG. 4, by a non-illustrated driving motor. In this embodiment, the polygon mirror 403 has a pentagonal column shape formed of five rectangular reflecting surfaces of the same size located around the rotary shaft 431. The cylinder lens 423 forms the image of the light beam on the reflecting surface of the polygon mirror 403, by converging only the sub scanning direction of the light beam.

Figure 5:
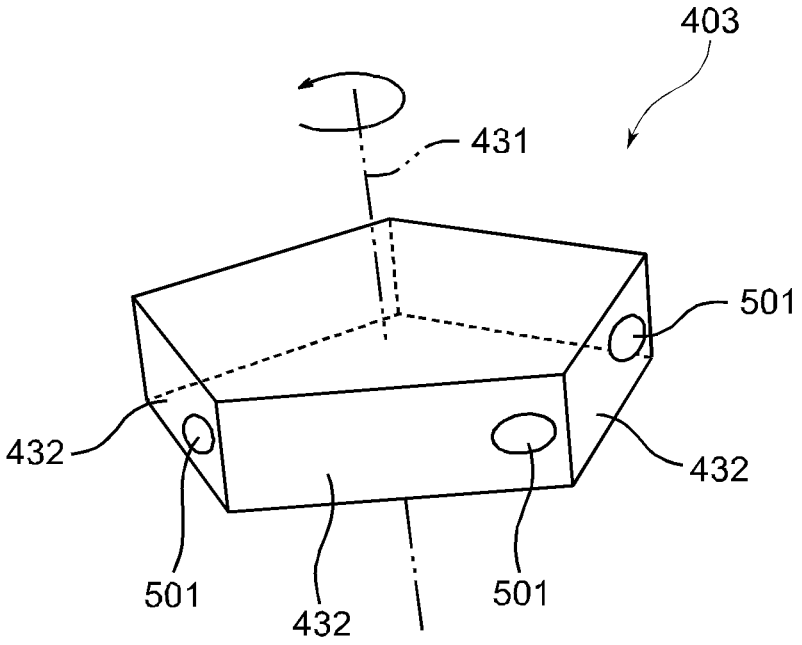
FIG. 5 is a schematic perspective view showing fog on a polygon mirror of the exposure unit according to the embodiment.

The polygon mirror 403 is configured to rotate about the rotary shaft 431, and therefore fog is formed, as mentioned earlier, on the reflecting surface owing to a turbulent flow of air generated in the vicinity of corner portions between the reflecting surfaces adjacent to each other. FIG. 5 is a schematic perspective view showing the positions where the fog is formed. As shown in FIG. 5, in the case where the polygon mirror 403 is driven to rotate counterclockwise about the rotary shaft 431 as indicated by an arrow in FIG. 5, dust sticks to a portion 501 of each reflecting surface 432 close to the leading end portion in the rotating direction, thus forming fog.

The light beam deflected by the rotation of the polygon mirror 403 enters the scanning optical system 404. In this embodiment, the scanning optical system 404 is an fθ lens composed of a pair of acrylic lenses, and forms the image of the light beam deflected by the polygon mirror 403 in spots on the surface of the photoconductor drum 141 at a generally constant scanning speed with respect to the photoconductor drum 141.

The exposure unit 143 also includes a BD optical system that generates a reference signal for starting to form the image on the photoconductor drum 141. The BD optical system includes a return mirror 411, a cylinder lens 412, and a BD sensor 413 (first sensor).

As shown in FIG. 4, the return mirror 411 is located at a position where the light beam reflected by one of the reflecting surfaces with the rotation of the polygon mirror 403 passes immediately before scanning the photoconductor drum 141. Here, FIG. 4 illustrates, in addition to the optical axis of the light beam reflected when the polygon mirror 403 is at the angle shown in FIG. 4, the optical axis of the light beam incident on the BD optical system, the optical axis of the light beam starting the scanning of the photoconductor drum 141, and the optical axis of the light beam finishing the scanning, for the sake of clarity of the description.

The light beam reflected by the return mirror 411 enters the BD sensor 413 having a photodetector such as a photodiode, through the cylinder lens 412. The cylinder lens 412 forms the image of the light beam on the light receiving surface of the BD sensor 413.

Figure 6:
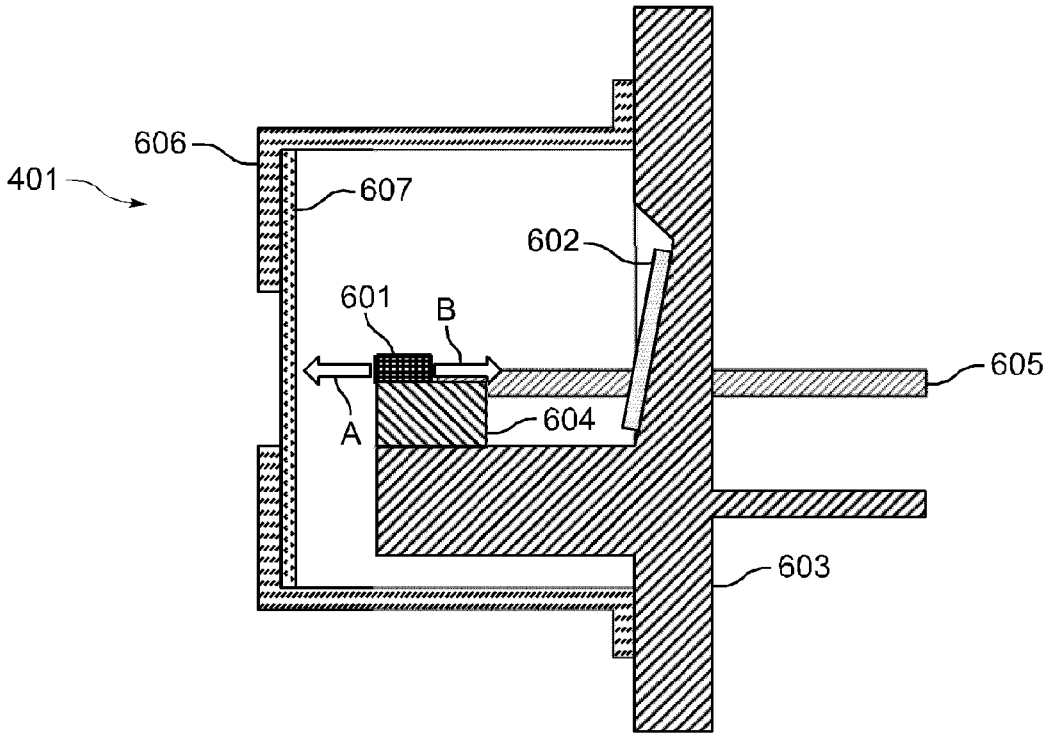
FIG. 6 is a cross-sectional view of a light source provided in the exposure unit according to the embodiment.

The configuration of the light source 401 will now be described. FIG. 6 is a cross-sectional view of the light source 401 provided in the multifunctional peripheral 100. The light source 401 includes a laser diode 601 fixed to a stem 603 via a submount 604. The laser diode 601 receives driving power through an electrode 605 penetrating through the stem 603 and reaching the laser diode 601. The stem 603 and the electrode 605 are mounted on the non-illustrated circuit board. The laser diode 601 is sealed with a cap 606 fixed to the stem 603. The cap 606 includes an opening opposing the light beam emission outlet of the laser diode 601, the opening being covered with a cover glass 607. The light beam outputted from the laser diode 601 is outwardly emitted through the cover glass 607.

The laser diode 601 outputs the light beam not only in the direction A toward the cover glass 607 but also in a direction B opposite to the direction A. An internal light sensor 602 constituted of a photodetector such as a photodiode is provided so as to oppose the emission outlet of the light beam proceeding in the direction B. The internal light sensor 602 serves to monitor the intensity of the light beam. The amount of the light beam outputted from the laser diode 601 and directly incident on the internal light sensor 602 (light beam proceeding in the direction B) fluctuates in proportion to the amount of the light beam proceeding in the direction A from the light source 401. The internal light sensor 602 outputs a voltage according to the amount of the light beam directly incident on the internal light sensor 602, as a feedback to a light intensity control unit 705 (see FIG. 7). The light intensity control unit 705 adjusts, upon receipt of the output voltage from the internal light sensor 602, the driving power supplied to the laser diode 601 through the electrode 605 such that the output voltage serves as the reference voltage, to thereby maintain the amount of the light beam emitted from the light source 401 at a constant reference light amount. In other words, the intensity of the light beam outwardly emitted through the cover glass 607 is adjusted according to the light beam intensity detected by the internal light sensor 602.

Figure 7:
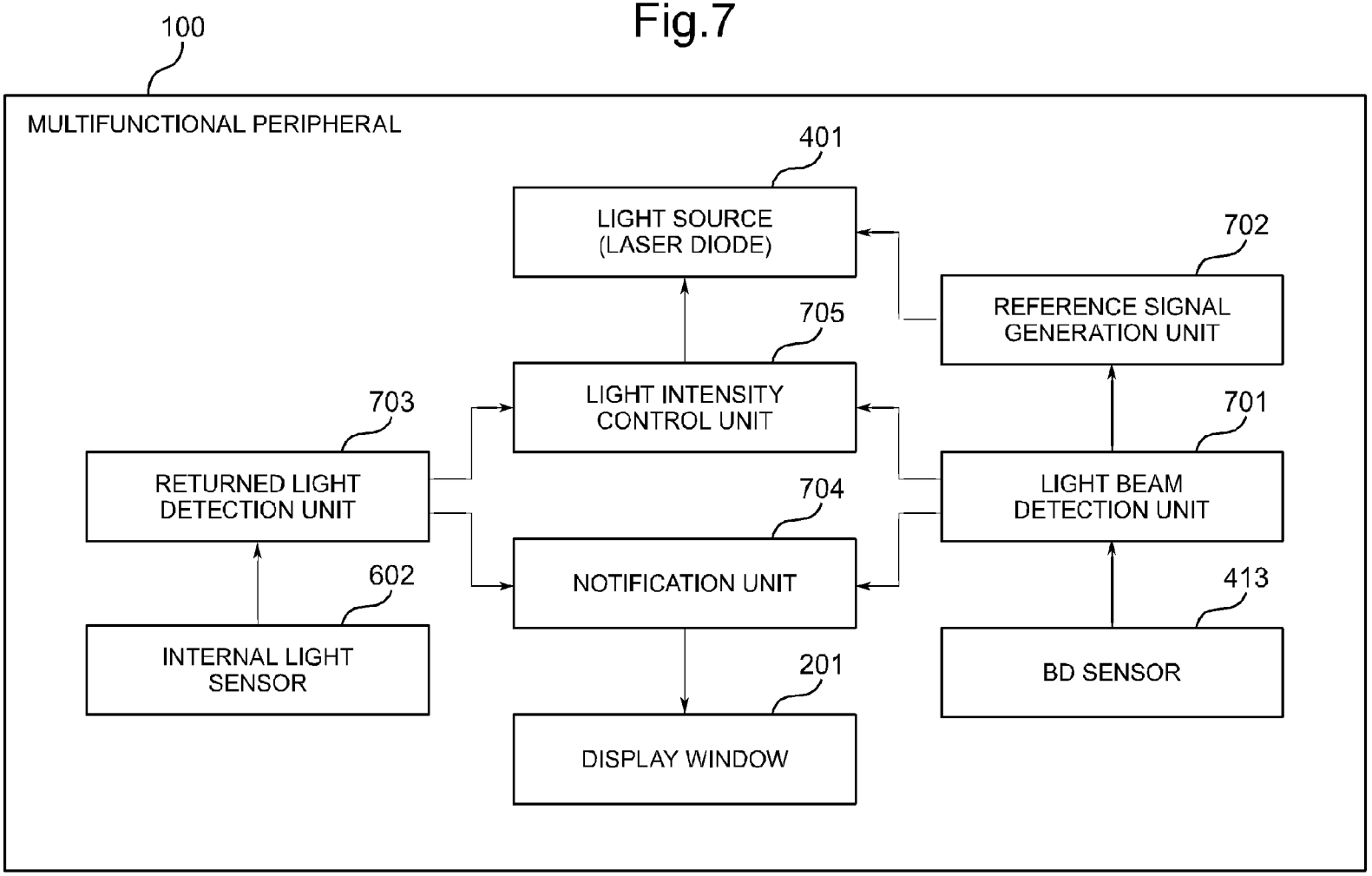
FIG. 7 is a functional block diagram showing a configuration of the multifunctional peripheral according to the embodiment.

FIG. 7 is a functional block diagram showing the configuration of the multifunctional peripheral 100 according to this embodiment. As shown in FIG. 7, the multifunctional peripheral 100 includes a light beam detection unit 701, a reference signal generation unit 702, and a returned light detection unit 703.

The light beam detection unit 701 decides whether the light beam deflected by a specific region of one of the reflecting surfaces has entered the BD sensor 413, through comparison between the output value of the BD sensor 413 and a first threshold. In this embodiment, the light beam detection unit 701 decides that the light beam deflected by the specific region of the reflecting surface has entered the BD sensor 413, when the output value of the BD sensor 413 is equal to or higher than the first threshold. In contrast, when the output value of the BD sensor 413 is lower than the first threshold, the light beam detection unit 701 decides that the light beam deflected by the specific region of the reflecting surface has not entered the BD sensor 413. The specific region of the reflecting surface will be subsequently described.

The reference signal generation unit 702 generates a reference signal for starting the scanning of the surface to be scanned with the light beam deflected by the one of the reflecting surfaces, when the light beam detection unit 701 detects that the light beam has entered the BD sensor 413. For example, the reference signal generation unit 702 generates a pulse signal when the light beam detection unit 701 decides that the light beam has entered the BD sensor 413. The light source 401 utilizes the pulse signal as the reference, so as to start emitting the light beam corresponding to the image data after a predetermined time has elapsed from the generation of the pulse signal.

The returned light detection unit 703 decides whether the light beam reflected by the specific region has entered the internal light sensor 602, through comparison between the output value of the internal light sensor 602 and a second threshold. The second threshold is set to a higher value than the first threshold. The second threshold is set, for example, to a value corresponding to light beam intensity higher than the laser beam outputted from the laser diode 601, or a value corresponding to light beam intensity higher than the intensity of the light beam reflected by the specific region. In this embodiment, the returned light detection unit 703 decides that the light beam reflected by the specific region has entered the internal light sensor 602, i.e., that the returned light has entered the internal light sensor 602, when the output value of the internal light sensor 602 is equal to or higher than the second threshold. In contrast, when the output value of the internal light sensor 602 is lower than the second threshold, the returned light detection unit 703 decides that the light beam reflected by the specific region of the reflecting surface has not entered the internal light sensor 602.

Here, it is not mandatory to provide the light beam detection unit 701 and the returned light detection unit 703 independent from each other, but one detection unit may also perform the function of the other detection unit.

The multifunctional peripheral 100 according to this embodiment further includes a notification unit 704 and a light intensity control unit 705. The notification unit 704 notifies the user of the decision result, in the case where the returned light detection unit 703 has decided that the light beam reflected by the specific region has not entered the internal light sensor 602. The notification method is not specifically limited, and various methods may be adopted as desired, such as a display, a hard copy, an e-mail, or facsimile, provided that the user can receive the notice. In this embodiment, the notification unit 704 displays the decision result on the display window 201 of the operation panel 200.

The light intensity control unit 705 increases the intensity of the light beam to be emitted from the light source 401, when the returned light detection unit 703 decides that the light beam reflected by the specific region has not entered the internal light sensor 602. Though not specifically limited, in this embodiment the light intensity control unit 705 is configured to increase the light beam intensity by a predetermined increment when the light beam is incident on the BD sensor 413 and the internal light sensor 602. When the light beam scans over the photoconductor drum 141, the light intensity control unit 705 increases the light beam intensity according to the magnitude of an intensity modulation signal inputted in correspondence with a scanning position on the photoconductor drum 141.

Figure 8A:
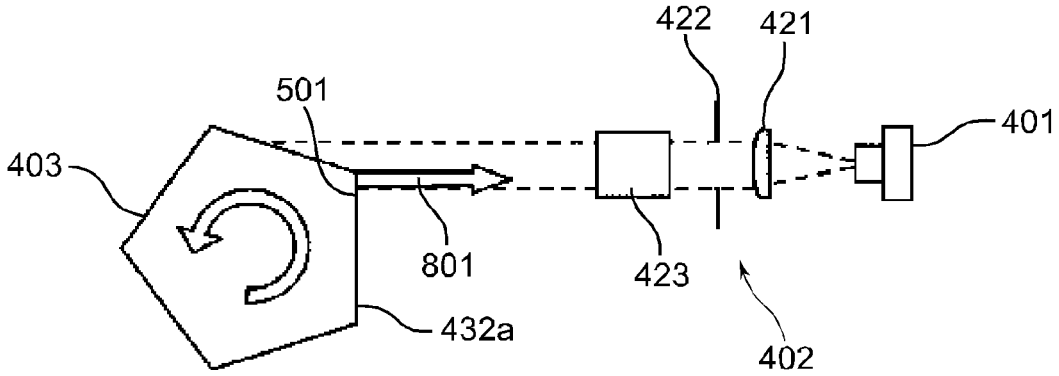
FIGS. 8A and 8B are schematic diagrams for explaining an operation of the exposure unit according to the embodiment, FIG. 8A showing a state where a light beam reflected by a reflecting surface is incident on an internal light sensor and FIG. 8B showing a state where a light beam reflected by the reflecting surface is incident on a BD sensor.
Figure 8B:
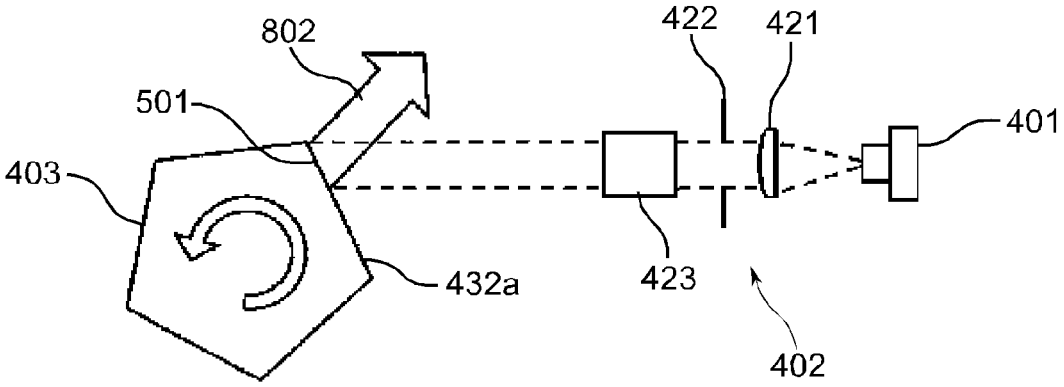

Hereunder, the specific region of the reflecting surface will be described. FIGS. 8A and 8B are schematic diagrams for explaining the operation of the exposure unit of the multifunctional peripheral 100 according to this embodiment. FIG. 8A illustrates a state where the light beam reflected by one of the reflecting surfaces 432*a* is incident on the internal light sensor 602, and FIG. 8B illustrates a state where the light beam reflected by the reflecting surface 432*a* is incident on the BD sensor 413. Blank arrows drawn in the polygon mirror 403 in FIGS. 8A and 8B indicate the rotating direction of the polygon mirror 403.

As is apparent from FIGS. 8A and 8B, the reflecting surface 432*a* of the polygon mirror 403 oriented as shown in FIG. 8A is shifted to the state shown in FIG. 8B with the rotation of the polygon mirror 403.

In the state shown in FIG. 8A, the light beam from the light source 401 that has passed through the input optical system 402 is reflected by the leading end portion (downstream end portion) 501 in the rotating direction of the reflecting surface 432*a* oriented perpendicular to the optical axis of the light beam. The reflected light beam 801 passes through the input optical system 402 and enters the light source 401. In other words, the reflected light beam 801 enters the internal light sensor 602.

In the state shown in FIG. 8B, the light beam from the light source 401 that has passed through the input optical system 402 is reflected by the leading end portion 501 of the reflecting surface 432*a* in the rotating direction. The reflected light beam 802 then enters the BD optical system. In other words, the reflected light beam 802 enters the BD sensor 413.

As described above, with the configuration according to this embodiment the light beam reflected by the leading end portion 501 of the reflecting surface 432*a* in the rotating direction, where fog is prone to be formed, is incident on each of the internal light sensor 602 and the BD sensor 413. Thus, the specific region of the reflecting surface according to this embodiment refers to the leading end portion 501 of the reflecting surface 432*a* in the rotating direction, where fog is prone to be formed (see FIG. 5). The situation shown in FIGS. 8A and 8B is commonly applicable to all the reflecting surfaces 432 constituting the polygon mirror 403.

Figure 9:
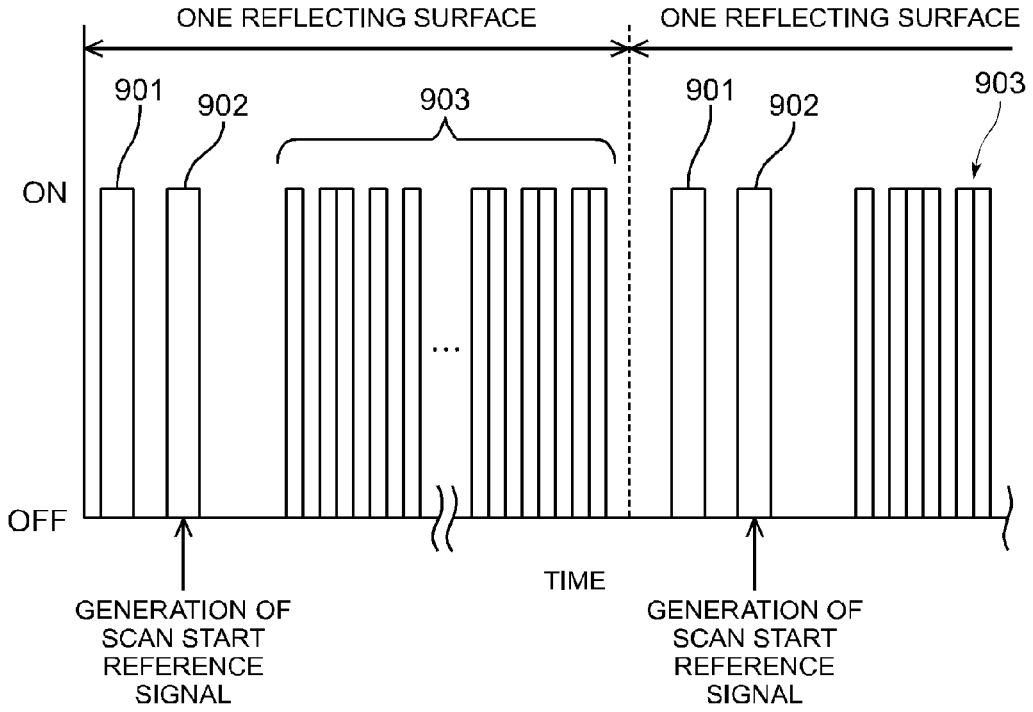
FIG. 9 is a timing chart showing ON/OFF timing of the light source in the exposure unit according to the embodiment.

As shown in FIG. 8A, further, in order to allow the light beam reflected by the polygon mirror 403 to enter the internal light sensor 602, the light source 401 has to be turned on at the time point that the optical axis of the light beam and the reflecting surface 432 of the polygon mirror 403 generally define the right angle. In this embodiment, therefore, the scan start reference signal generated by the reference signal generation unit 702 is utilized as the reference to determine the time point to turn on the light source 401. FIG. 9 is a timing chart showing the on/off timing of the light source 401. In FIG. 9, the horizontal axis represents the time, and the vertical axis represents the on and off states of the light source 401.

As stated earlier, the light source 401 starts to emit the light beam corresponding to the image data after a predetermined time from the generation of the scan start reference signal. In FIG. 9, the emission of the light beam corresponding to the image data is expressed by a blinking sequence 903. A turning on 902 indicates the point where the light source 401 is turned on to cause the light beam to enter the BD sensor 413. The turning on 902 is performed after a predetermined time based on the rotation speed of the polygon mirror 403, with respect to the immediately preceding scan start reference signal. In the case where the light beam detection unit 701 detects that the light beam has entered the BD sensor 413 in the period corresponding to the turning on 902, the reference signal generation unit 702 generates the scan start reference signal.

As shown in FIG. 9, a turning on 901 of the light source 401 for cause the light beam to enter the internal light sensor 602 is performed after the scan start reference signal is generated and the blinking sequence 903 is finished, and before the turning on 902 of the light source 401 for causing the light beam to enter the BD sensor 413 is performed. The turning on 901 is performed utilizing the immediately preceding scan start reference signal as the reference and, as is apparent from FIGS. 8A and 8B, the light beam is reflected by the same reflecting surface during the turning on 902 and the blinking sequence 903 following the turning on 901. Here, although the light source 401 is configured to be turned on and off depending on whether the light beam is scanning over the photoconductor drum 141 in this embodiment, the light source 401 may be continuously turned on.

In this embodiment, the light beam intensity is adjusted after the turning on 901 of the light source 401 for causing the light beam to enter the internal light sensor 602, and before the turning on 902 for causing the light beam to enter the BD sensor 413.

Figure 10A:
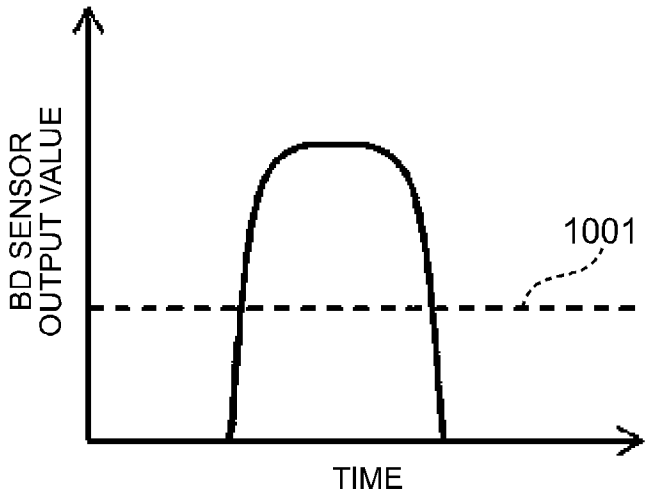
FIGS. 10A and 10B are graphs for explaining an operation principle of the multifunctional peripheral according to the embodiment, FIG. 10A showing an output value of the BD sensor and FIG. 10B showing an output value of the internal light sensor, obtained when the reflecting surface of the polygon mirror is free from fog.
Figure 10B:
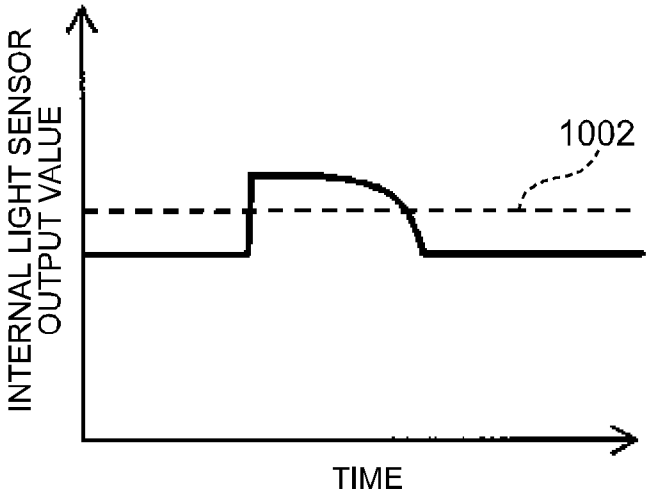
Figure 11B:
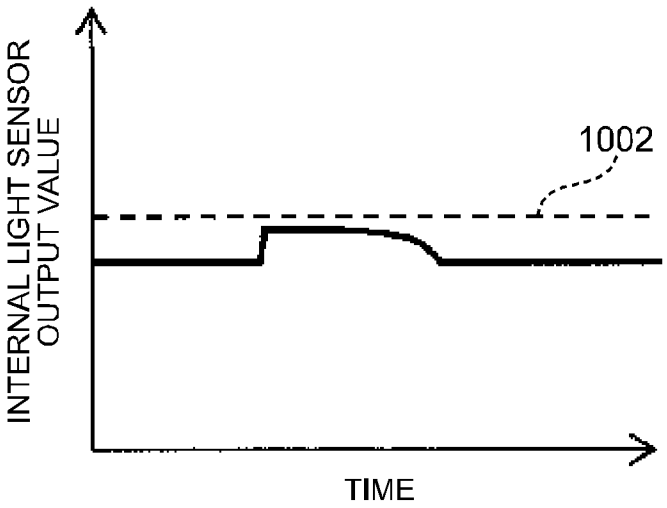
FIGS. 11A and 11B are graphs for explaining an operation principle of the multifunctional peripheral according to the embodiment, FIG. 11A showing an output value of the BD sensor and FIG. 11B showing an output value of the internal light sensor, obtained when the reflecting surface of the polygon mirror is fogged.
Figure 11A:
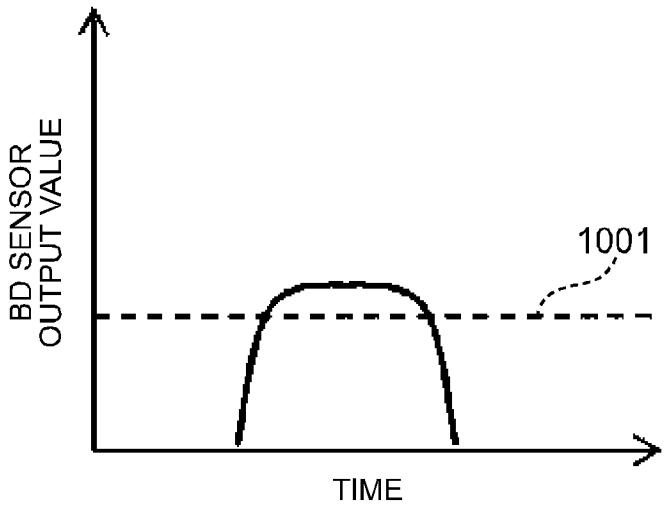

Hereunder, the operation principle of the multifunctional peripheral 100 according to this embodiment will be described. FIGS. 10A and 10B are graphs showing the output values of the BD sensor 413 and the internal light sensor 602, obtained when the reflecting surfaces 432 of the polygon mirror 403 are free from fog. FIG. 10A shows the output value of the BD sensor, and FIG. 10B shows the output value of the internal light sensor 602. In addition, FIGS. 11A and 11B are graphs showing the output values of the BD sensor 413 and the internal light sensor 602, obtained when the reflecting surfaces 432 of the polygon mirror 403 are fogged. FIG. 11A shows the output value of the BD sensor 413 and FIG. 11B shows the output value of the internal light sensor 602. In FIGS. 10A, 10B, 11A, and 11B, the horizontal axis represents the time and the vertical axis represents the output value (voltage) of each of the sensors. A line 1001 drawn in FIGS. 10A and 11A indicates the first threshold, and a line 1002 drawn in FIGS. 10B and 11B indicates the second threshold.

As shown in FIGS. 10A and 10B, the output value of the BD sensor 413 is higher than the first threshold 1001 and the output value of the internal light sensor 602 is also higher than the second threshold 1002, when the reflecting surfaces 432 of the polygon mirror 403 are free from fog. Therefore, the light beam detection unit 701 decides that the light beam has entered the BD sensor 413, and the reference signal generation unit 702 generates the scan start reference signal in response to such decision. Likewise, the returned light detection unit 703 decides that the light beam has entered the internal light sensor 602. In this case, the image formation process is performed without taking any additional step. Here, as is apparent from the waveform of the output value of the internal light sensor 602 shown in FIG. 10B, the internal light sensor 602 is constantly receiving the light beam from the laser diode 601 while the light source 401 is emitting the light beam (see FIG. 6). Accordingly, when the reflected light beam enters the internal light sensor 602, the value corresponding to the reflected light beam is superposed on the value constantly being outputted on the basis of the light beam from the laser diode 601.

On the other hand, when fog is formed on the reflecting surface 432 of the polygon mirror 403, the intensity of the light beam reflected by the leading end portion 501 of the reflecting surface 432 in the rotating direction gradually declines as the fog spreads. Accordingly, the intensity of the light beam incident on the internal light sensor 602 and the BD sensor 413 gradually declines.

In this embodiment, the light beam intensity corresponding to the second threshold 1002 set in the returned light detection unit 703 is higher than the light beam intensity corresponding to the first threshold 1001 set in the light beam detection unit 701, with respect to the intensity of the light beam reflected by the same region (leading end portion 501 of the reflecting surface 432 in the rotating direction). Accordingly, first the output value of the light beam detection unit 701 becomes lower than the second threshold 1002 in the stage where fog starts to be formed on the reflecting surface 432 of the polygon mirror 403 and the intensity of the light beam incident on the internal light sensor 602 and the BD sensor 413 gradually declines (see FIG. 11B). Immediately after the intensity of the light beam incident on the internal light sensor 602 has become lower than the second threshold 1002, the intensity of the light beam incident on the BD sensor 413 (output value of the BD sensor 413) is higher than the first threshold 1001, as shown in FIG. 11A. In this state, the light beam detection unit 701 decides that the light beam has entered the BD sensor 413, and the reference signal generation unit 702 generates the scan start reference signal in response to such decision. In contrast, the returned light detection unit 703 decides that the light beam has not entered the internal light sensor 602.

In this case, the multifunctional peripheral 100 according to this embodiment causes the notification unit 704 to display the decision result on the display window 201. In addition, the light intensity control unit 705 increases the intensity of the light beam that enters the BD sensor 413 and the internal light sensor 602, by a predetermined increment. With respect to the light beam that scans over the photoconductor drum 141, the light intensity control unit 705 increases the intensity of the light beam according to the magnitude of the intensity modulation signal inputted in correspondence with the scanning position on the photoconductor drum 141.

In the case where the light beam intensity is not increased, the intensity of the light beam incident on the BD sensor 413 becomes lower than the first threshold, when the fog further spreads thereby decreasing the intensity of the reflected light beam. In this case, the reference signal generation unit 702 is unable to generate the scan start reference signal, and therefore the image forming unit 140 is disabled from performing the image forming. In addition, in case that the fog reaches, before the light beam intensity becomes lower than the first threshold, the region that reflects the light beam corresponding to the image data toward the photoconductor drum 141, the image quality is degraded since the intensity of the light beam reflected by that region is insufficient.

Figure 12:
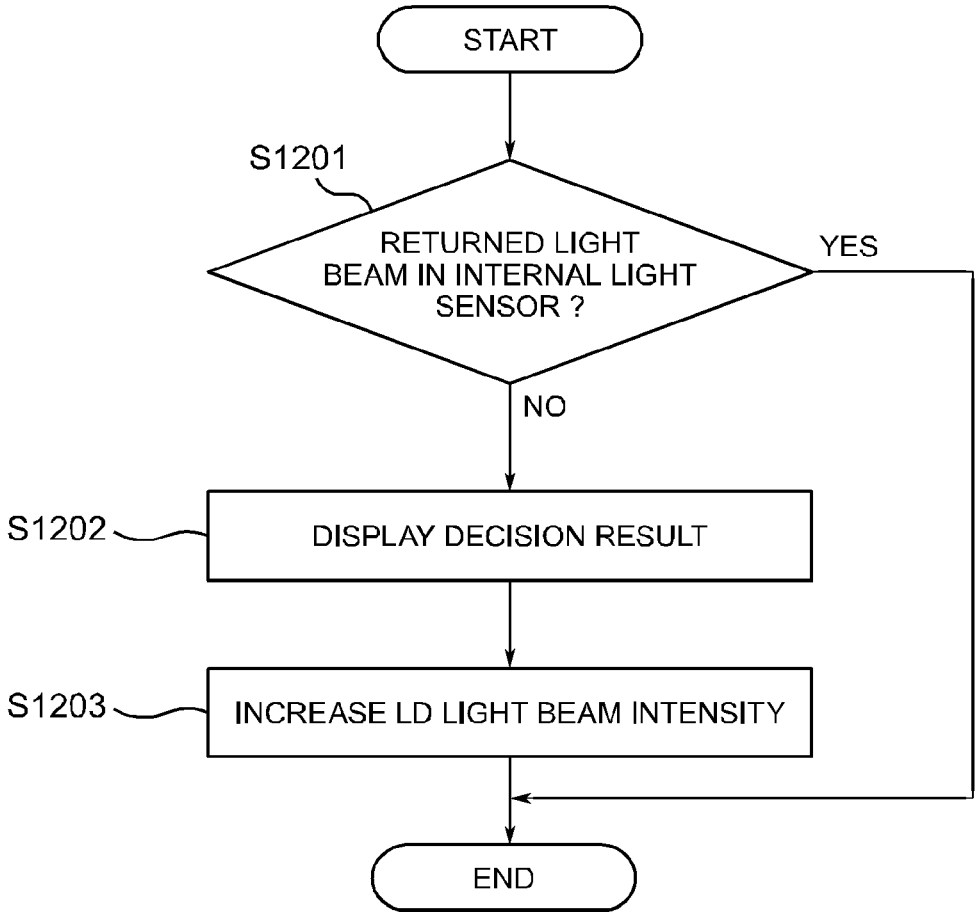
FIG. 12 is a flowchart showing a process performed by the multifunctional peripheral according to the embodiment when light beam intensity is lowered.

FIG. 12 is a flowchart showing a process performed by the multifunctional peripheral 100 when light beam intensity is lowered. This process is repeatedly started at predetermined time intervals, when the exposure unit 143 is operating.

When the process is started, the returned light detection unit 703 decides whether the light beam reflected by the polygon mirror 403 has entered the internal light sensor 602, by the aforementioned method (step S1201). When the returned light detection unit 703 decides that the reflected light beam has entered the internal light sensor 602 (Yes at S1201), the process is finished without taking any additional step. In contrast, in the case where the returned light detection unit 703 has decided that the reflected light beam has not entered the internal light sensor 602 (No at S1201), the returned light detection unit 703 notifies the notification unit 704 and the light intensity control unit 705 to this effect.

Figure 13A:
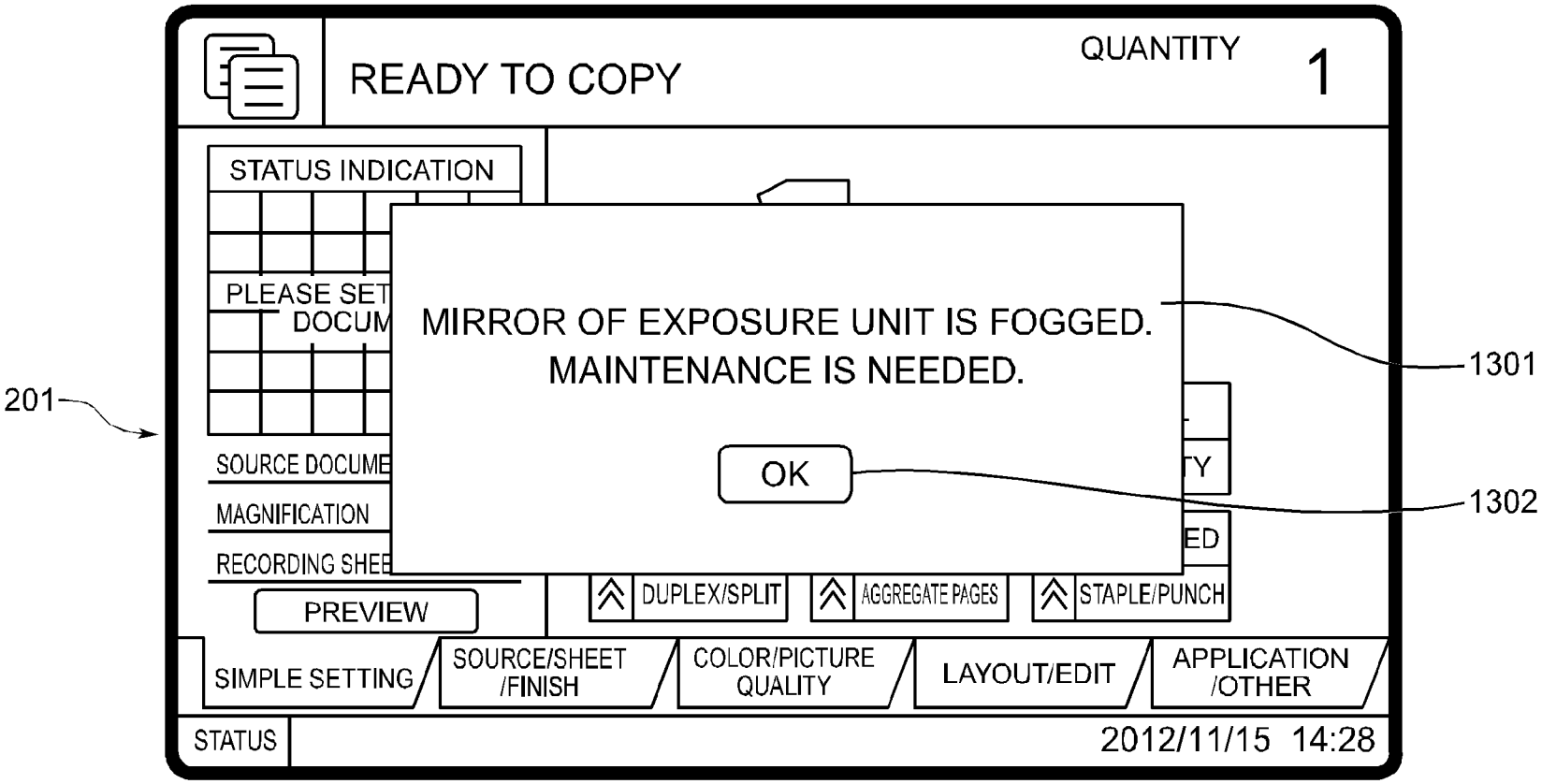
FIGS. 13A and 13B are drawings of screen examples displayed by a notification unit of the multifunctional peripheral according to the embodiment.
Figure 13B:
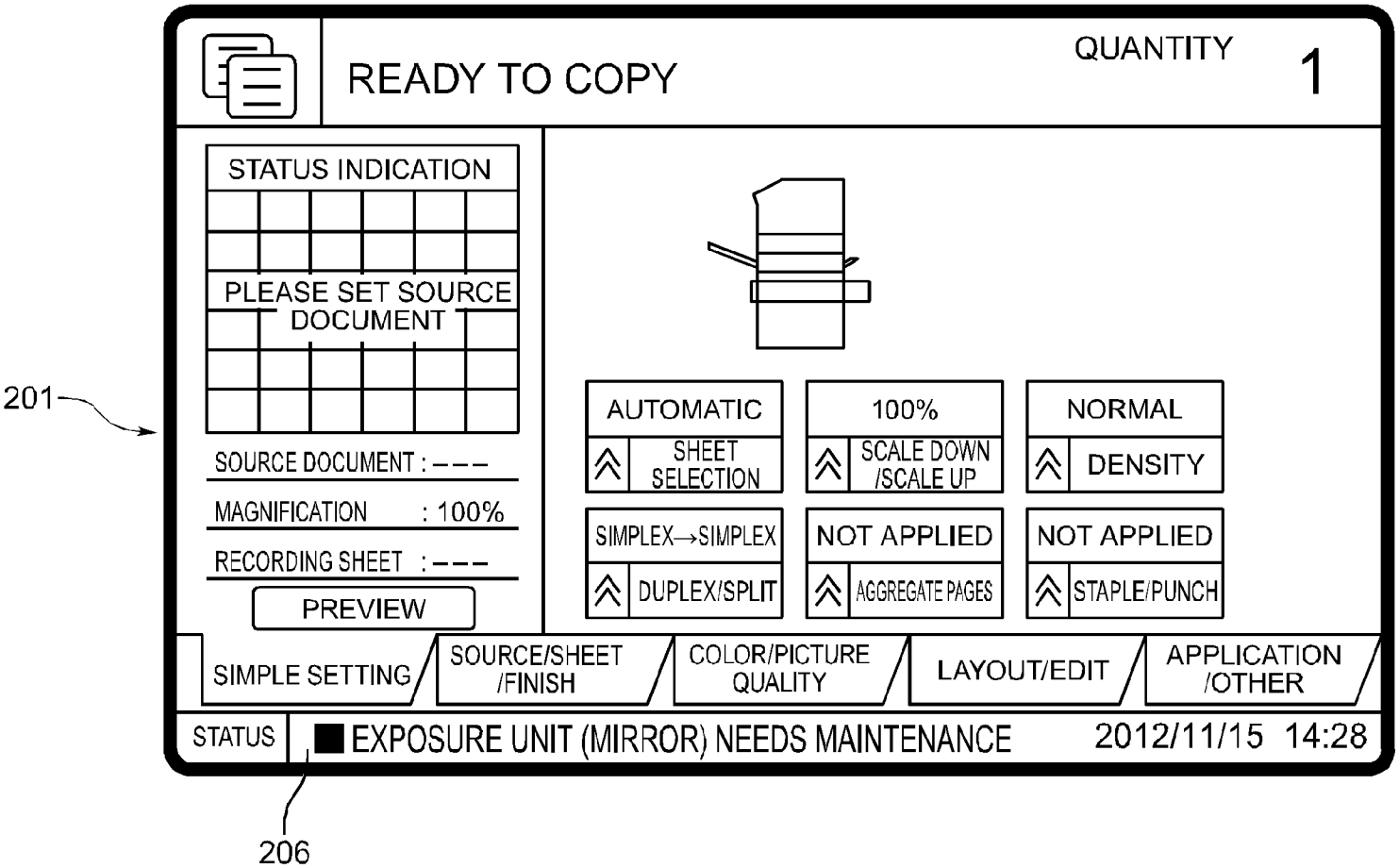

The notification unit 704 displays the decision result on the display window 201, upon receipt of the notification (step S1202). FIG. 13A illustrates an example of the screen displayed on the display window 201 by the notification unit 704. In this example, a pop-up window 1301 including such a message as "Mirror of exposure unit is fogged. Maintenance is needed" is displayed on the display window 201. The pop-up window 1301 includes an OK button 1302, so that when the user presses the OK button 1302 upon recognizing the message the pop-up window 1301 is closed. FIG. 13B illustrates another example of the screen displayed on the display window 201 by the notification unit 704. In this example, such a message as "Exposure unit (mirror) needs maintenance" is displayed in the status display area 206 of the display window 201.

Further, upon receipt of the mentioned notification the light intensity control unit 705 increases the intensity of the light beam to be outputted by the laser diode 601 of the light source 401 as described above (S1203). In this embodiment, the light intensity control unit 705 increases the intensity of the light beam by a predetermined increment with respect to the light beam that enters the BD sensor 413 and the internal light sensor 602, and increases intensity of the light beam according to (in proportion to) the magnitude of the intensity modulation signal inputted in correspondence with the scanning position on the photoconductor drum 141, with respect to the light beam that scans over the photoconductor drum 141.

Now, the technique of preventing degradation of image quality by not using the region on the reflecting surface of the polygon mirror where fog is assumed to be formed is known. With such a technique, however, the length of the reflecting surface of the polygon mirror inevitably has to be increased, since a part of the reflecting surface is not to be used. Therefore, the polygon mirror has to be formed in a larger diameter, which leads to an increase in size of the scanning optical apparatus.

In addition, a scanning optical apparatus is known that does not include the reflecting mirror and the photodiode (BD sensor) for generating the scan start signal, but is configured to detect a laser beam emitted from a laser oscillation element serving as the light source and reflected by a scanning mirror so as to return to the laser oscillation element, and to thereby generate the scan start signal. However, although the scanning optical apparatus thus configured can operate without the BD optical system including the BD sensor, the scanning optical apparatus is unable to prevent degradation of image quality originating from fog formed on the reflecting surface of the polygon mirror.

The multifunctional peripheral 100 according to this embodiment, including the exposure unit 143 corresponding to the scanning optical apparatus in the disclosure, is appropriate for solving the foregoing drawbacks, because of being configured to prevent degradation of image quality and malfunction of the apparatus even when fog is formed on the reflecting surface of the polygon mirror, without incurring an increase in size of the polygon mirror.

More specifically, when fog is formed on the reflecting surfaces 432 constituting the polygon mirror 403 in the multifunctional peripheral 100, the internal light sensor 602 is disabled from detecting the light beam incident thereon because of the fog, before the BD sensor 413 is disabled from detecting the light beam incident thereon. Accordingly, the decline in intensity of the light beam can be detected using the internal light sensor 602, before degradation of image quality and malfunction of the apparatus are incurred owing to fog. Such an arrangement allows necessary measures to be taken, even though fog is formed on the reflecting surfaces 432 constituting the polygon mirror 403, to cope with the decline in light beam intensity before degradation of image quality and malfunction of the apparatus are incurred owing to the fog.

In the light source 401 including the laser diode 601, the internal light sensor 602 for monitoring the intensity of the light beam outputted from the light source 401 thereby adjusting the light beam intensity is provided so as to oppose the end of the laser diode 601 opposite to the light beam emission outlet. The presence of the internal light sensor 602 thus located eliminates the need to provide an additional sensor or an additional reflecting mirror.

The exposure unit 143 further includes the notification unit 704. In the case where the returned light detection unit 703 decides that the light beam reflected by the reflecting surface 432 has not entered the internal light sensor 602, the notification unit 704 notifies the user to this effect. The notification method is not specifically limited, and various methods may be adopted as desired, such as a display, a hard copy, an e-mail, or facsimile, provided that the user can receive the notice. The mentioned arrangement allows the user to be aware of the decline in light beam intensity and take necessary measures, before degradation of image quality and malfunction of the apparatus are incurred owing to fog formed on the reflecting surfaces 432 constituting the polygon mirror 403.

The exposure unit 143 further includes the light intensity control unit 705. The light intensity control unit 705 increases the intensity of the light beam to be emitted from the light source 401, when the returned light detection unit 703 decides that the light beam reflected by the reflecting surface 432 has not entered the internal light sensor 602. Such an arrangement allows the light beam intensity to be automatically increased before degradation of image quality and malfunction of the apparatus are incurred owing to fog formed on the reflecting surfaces 432 constituting the polygon mirror 403, and also prevents degradation of image quality and malfunction of the apparatus that may subsequently take place. In this case, the light intensity control unit 705 increases the intensity of the light beam to enter the BD sensor 413 and the internal light sensor 602 by a predetermined increment, and increases the intensity of the light beam according to the magnitude of the intensity modulation signal inputted in correspondence with the scanning position on the photoconductor drum 141, with respect to the light beam for scanning the photoconductor drum 141.

The foregoing embodiment is in no way intended to limit the technical scope of the disclosure, and various modifications may be made within the scope and spirit of the disclosure. For example, the light intensity control unit 705 according to the foregoing embodiment is configured to increase the intensity of the light beam to enter the BD sensor 413 and the internal light sensor 602 by a predetermined increment, and to increase the intensity of the light beam according to the magnitude of the intensity modulation signal inputted in correspondence with the scanning position on the photoconductor drum 141, with respect to the light beam for scanning the photoconductor drum 141. Alternatively, the light intensity control unit 705 may be configured to increase only the intensity of the light beam to enter the BD sensor 413 and the internal light sensor 602 by a predetermined increment. Such a configuration can at least prevent the reference signal generation unit 702 from being disabled from generating the scan start reference signal. The mentioned alternative configuration can also prevent degradation of image quality, unless fog reaches the region on the reflecting surface 432 that reflects the light beam corresponding to the image data toward the photoconductor drum 141.

Although the multifunctional peripheral 100 according to the foregoing embodiment includes the notification unit 704 and the light intensity control unit 705, these units are not mandatory in the disclosure. For example, either of the notification unit 704 and the light intensity control unit 705, or neither thereof may be provided in the multifunctional peripheral 100. In the case where the multifunctional peripheral 100 only includes the notification unit 704, the user can be aware of the decline in light beam intensity and take necessary measures, before degradation of image quality and malfunction of the apparatus are incurred owing to fog. In the case where the multifunctional peripheral 100 only includes the light intensity control unit 705, the light beam intensity can be automatically increased before degradation of image quality and malfunction of the apparatus are incurred owing to fog, and degradation of image quality and malfunction of the apparatus that may subsequently take place can also be prevented. Further, even though the multifunctional peripheral 100 includes neither of the notification unit 704 and the light intensity control unit 705, the decline in light beam intensity can be discovered and necessary measures can be taken before degradation of image quality and malfunction of the apparatus are incurred owing to fog, for example by allowing a service person to select a maintenance menu and to review the decision result of the returned light detection unit 703.

Further, although the disclosure is embodied by the digital multifunctional peripheral in the foregoing description, the disclosure is broadly applicable to desired image forming apparatuses such as a printer and a copier, without limitation to the digital multifunctional peripheral. The disclosure may further be applied to desired scanning optical apparatuses that include a polygon mirror.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A scanning optical apparatus comprising:

a light source;

a polygon mirror including a plurality of reflecting surfaces that reflect a light beam emitted from the light source, and configured to move the reflecting surfaces to deflect the light beam emitted from the light source, so as to scan a surface to be scanned in a main scanning direction;

a first sensor that receives the light beam reflected by the reflecting surfaces of the polygon mirror;

a second sensor located inside the light source so as to intersect the optical axis of the light beam at a position opposite to an emission outlet of the light beam, the second sensor being receives the light beam reflected by the reflecting surface and detects intensity of the light beam received;

a light beam detection unit that compares between an output value of the first sensor and a predetermined first threshold, to thereby decide that the light beam reflected by the reflecting surface has entered the first sensor when the output value of the first sensor is equal to or higher than the first threshold, and that the light beam reflected by the reflecting surface has not entered the first sensor when the output value of the first sensor is lower than the first threshold;

a reference signal generation unit that generates a scan start reference signal for starting scanning of the surface to be scanned with the light beam deflected by the reflecting surface, when the light beam detection unit detects that the light beam has entered the first sensor; and a returned light detection unit that compares between an output value of the second sensor and a second threshold corresponding to light beam intensity higher than the intensity of the light beam reflected by the reflecting surface and corresponding to the first threshold, to thereby decide that the light beam reflected by the reflecting surface has entered the second sensor when the output value of the second sensor is equal to or higher than the second threshold, and that the light beam reflected by the reflecting surface has not entered the second sensor when the output value of the second sensor is lower than the second threshold.

2. The scanning optical apparatus according to claim 1, further comprising a notification unit that notifies, when the returned light detection unit decides that the light beam reflected by the reflecting surface has not entered the second sensor, a user of the decision result.

3. The scanning optical apparatus according to claim 1, further comprising a light intensity control unit that increases intensity of the light beam to be emitted from the light source when the returned light detection unit decides that the light beam reflected by the reflecting surface has not entered the second sensor.

4. The scanning optical apparatus according to claim 3, wherein the light intensity control unit increases intensity of the light beam by a predetermined increment with respect to the light beam that enters the first sensor and the second sensor, and increases intensity of the light beam according to a magnitude of an intensity modulation signal inputted in correspondence with a scanning position on the surface to be scanned, with respect to the light beam that scans over the surface to be scanned.

5. The scanning optical apparatus according to claim 1, wherein the second sensor further detects intensity of the light beam emitted from the light source and directly incident on the second sensor, the scanning optical apparatus further comprising a light intensity control unit that maintains an amount of the light beam emitted from the light source at a constant amount, by adjusting driving power to be supplied to the light source such that intensity of the light beam emitted from the light source and directly incident on the second sensor to be thereby detected matches predetermined intensity.

6. An image forming apparatus comprising:

a scanning optical apparatus;

an image carrier that carries a toner image to be transferred to a medium;

a charger that electrically charges an image carrying surface of the image carrier; and a developing unit that applies a toner to a static latent image formed by exposure of the image carrying surface performed by the scanning optical apparatus, thereby forming a toner image based on the latent image on the image carrying surface, wherein the scanning optical apparatus includes:

a light source;

a polygon mirror including a plurality of reflecting surfaces that reflect a light beam emitted from the light source, and configured to move the reflecting surfaces to deflect the light beam emitted from the light source, so as to scan a surface to be scanned in a main scanning direction;

a first sensor that receives the light beam reflected by the reflecting surfaces of the polygon mirror;

a second sensor that receives the light beam reflected by the reflecting surface and detects intensity of the light beam received, the second sensor being located inside the light source so as to intersect the optical axis of the light beam at a position opposite to an emission outlet of the light beam;

a light beam detection unit that compares between an output value of the first sensor and a predetermined first threshold, to thereby decide that the light beam reflected by the reflecting surface has entered the first sensor when the output value of the first sensor is equal to or higher than the first threshold, and that the light beam reflected by the reflecting surface has not entered the first sensor when the output value of the first sensor is lower than the first threshold;

a reference signal generation unit that generates a scan start reference signal for starting scanning of the surface to be scanned with the light beam deflected by the reflecting surface, when the light beam detection unit detects that the light beam has entered the first sensor; and a returned light detection unit that compares between an output value of the second sensor and a second threshold corresponding to light beam intensity higher than the intensity of the light beam reflected by the reflecting surface and corresponding to the first threshold, to thereby decide that the light beam reflected by the reflecting surface has entered the second sensor when the output value of the second sensor is equal to or higher than the second threshold, and that the light beam reflected by the reflecting surface has not entered the second sensor when the output value of the second sensor is lower than the second threshold.

* * * * *